US008325115B2

(12) United States Patent
Tada et al.

(10) Patent No.: US 8,325,115 B2
(45) Date of Patent: Dec. 4, 2012

(54) SELF-LUMINOUS DISPLAY APPARATUS, PEAK LUMINANCE ADJUSTMENT APPARATUS, ELECTRONIC APPARATUS, PEAK LUMINANCE ADJUSTMENT METHOD AND PROGRAM

(75) Inventors: Mitsuru Tada, Kanagawa (JP); HIroshi Hasegawa, Kanagawa (JP); Atsushi Ozawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 816 days.

(21) Appl. No.: 11/603,215

(22) Filed: Nov. 22, 2006

(65) Prior Publication Data

US 2007/0126672 A1 Jun. 7, 2007

(30) Foreign Application Priority Data

Nov. 25, 2005 (JP) ..... P2005-340436

(51) Int. Cl.
*G09G 3/30* (2006.01)

(52) U.S. Cl. ..... 345/77

(58) Field of Classification Search ..... 345/87, 345/77, 590, 169, 63
See application file for complete search history.

(56) References Cited

U.S. PATENT DOCUMENTS

| | | | | |
|---|---|---|---|---|
| 6,326,938 | B1 * | 12/2001 | Ishida et al. | 345/63 |
| 2006/0152634 | A1 * | 7/2006 | Yeh et al. | 348/701 |

FOREIGN PATENT DOCUMENTS

| | | | |
|---|---|---|---|
| JP | 2001-343941 | | 12/2001 |
| JP | 2002-032052 | A | 1/2002 |
| JP | 2002-132218 | | 5/2002 |
| JP | 2003-015605 | | 1/2003 |
| JP | 2005-275048 | A | 10/2005 |
| JP | 2006-113212 | A | 4/2006 |
| JP | 2006-201399 | A | 8/2006 |

OTHER PUBLICATIONS

Japanese Office Action issued Aug. 2, 2011 for corresponding Japanese Application No. 2005-340436.

* cited by examiner

*Primary Examiner* — Quan-Zhen Wang
*Assistant Examiner* — Tony Davis
(74) *Attorney, Agent, or Firm* — Rader Fishman & Grauer, PLLC

(57) ABSTRACT

A self-luminous display apparatus, a peak luminance adjustment apparatus is disclosed wherein power to be consumed by a self-luminous display panel is compulsorily suppressed to a level within a prescribed range and consequently the life of a battery is maintained. A mean gradation value calculation section calculates a mean gradation value of a video signal inputted within a period of one frame. A power consumption calculation section determines a standard peak luminance corresponding to the calculated mean gradation value and calculates a power consumption amount to be consumed based on the standard peak luminance and the calculated mean gradation value. A peak luminance adjustment section adjusts the standard peak luminance so that a total value of the power consumption to be consumed within a fixed period of time may not exceed a preset power amount.

8 Claims, 12 Drawing Sheets

FIG. 9

| APLn | SEL_PKn |
|---|---|
| 0 | 2.0 |
| 1 | 1.9 |
| 2 | 1.8 |
| ... | ... |
| ... | ... |
| 254 | 0.5 |
| 255 | 0.4 |

SELF-LUMINOUS DISPLAY APPARATUS, PEAK LUMINANCE ADJUSTMENT APPARATUS, ELECTRONIC APPARATUS, PEAK LUMINANCE ADJUSTMENT METHOD AND PROGRAM

CROSS REFERENCES TO RELATED APPLICATIONS

The present invention contains subject matter related to Japanese Patent Application JP 2005-340436 filed with the Japanese Patent Office on November 25, the entire contents of which being incorporated herein by reference.

BACKGROUND OF THE INVENTION

1. Field of the Invention

This invention relates to a self-luminous display apparatus, a peak luminance adjustment apparatus, an electronic apparatus, a peak luminance adjustment method and a program wherein power to be consumed by a self-luminous display panel is compulsorily suppressed to a level within a prescribed range.

2. Description of the Related Art

An organic EL display apparatus is superior not only in the wide view angle characteristic, high response speed, wide color reproduction range and high contrast but also in that it allows a display panel itself to be formed with a small thickness. Thanks to the advantages mentioned, an organic EL display apparatus draws attention as the most promising candidate for a next-generation flat panel display apparatus.

Further, in recent years, a technique for improving the speed of response or the contrast performance through variable control of the light emission time is investigated. A variable control technique of the light emission time is disclosed, for example, in Japanese Patent Laid-Open No. 2003-015605 (hereinafter referred to as Patent Document 1), Japanese Patent Laid-Open No. 2001-343941 (hereinafter referred to as Patent Document 2) or Japanese Patent Laid-Open No. 2002-132218 (hereinafter referred to as Patent Document 3).

SUMMARY OF THE INVENTION

Incidentally, the techniques disclosed in Patent Documents 1 to 3 are all directed to improvement of the picture quality. However, they lack in investigation of the point of view regarding uniformization of the power consumption or suppression of the power consumption.

In fact, different from a display apparatus of the type wherein a backlight of a fixed luminance is normally kept in a lighting state, self-luminous display apparatus including an organic EL display apparatus have a characteristic that the amount of current flowing through the display panel varies dramatically in response to a video signal inputted thereto.

Due to the characteristic described, the power consumption of a self-luminance display apparatus per unit period of time is not fixed. In other words, the self-luminance display apparatus have a problem that the power consumption of the display panel varies radically in response to the displayed substance. Further, where an electronic apparatus in which the display panel is incorporated is driven by a battery, there is a problem that the time of use varies extremely in response to the display substance. In order to solve this problem, it is necessary to use a battery of a great capacity.

According to an embodiment of the present invention, there is provided a self-luminous display apparatus capable of variably controlling a peak luminance of a face of a self-luminous panel in a unit of one frame, having a mean gradation value calculation section configured to calculate a mean gradation value of a video signal inputted within a period of one frame, a power consumption calculation section configured to determine a standard peak luminance corresponding to the calculated mean gradation value and calculate a power consumption amount to be consumed based on the standard peak luminance and the calculated mean gradation value, and a peak luminance adjustment section configured to adjust the standard peak luminance so that a total value of the power consumption to be consumed within a fixed period of time may not exceed a preset power amount.

With the self-luminous display apparatus, the power amount to be consumed by the self-luminous panel can be fixed or suppressed lower than a fixed level.

The above and other features and advantages of the present invention will become apparent from the following description and the appended claims, taken in conjunction with the accompanying drawings in which like parts or elements denoted by like reference symbols.

BRIEF DESCRIPTION OF THE DRAWINGS

FIG. 9 is a view illustrating an example of a lookup table wherein a peak luminance magnification is coordinated with an average gradation value;

DETAILED DESCRIPTION OF THE PREFERRED EMBODIMENTS

In the following, an organic EL panel module in which a processing function according to the present invention is incorporated.

It is to be noted that, to matters which are not specifically described herein or not specifically illustrated in the accompanying drawings, well-known or publicly known techniques in the pertaining technical field are applied.

A. Adjustment of the Peak Luminance

The peak luminance of a display panel can be adjusted by variably controlling the output voltage or output current applied to or the light emission time period of a display element when maximum data is inputted.

Figure 1:
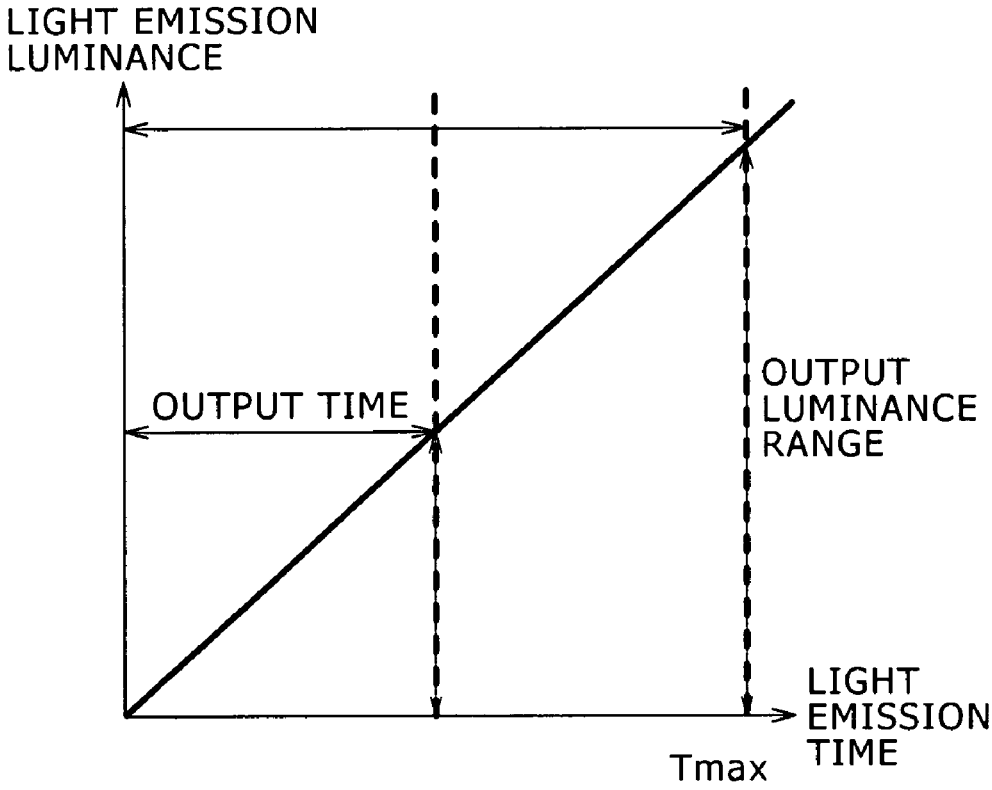
FIG. 1 is a diagram illustrating a relationship between the light emission time period and the light emission luminance.

FIG. 1 illustrates a relationship between the light emission time period and the light emission luminance. As seen in FIG. 1, the light emission luminance varies linearly with respect to the light emission time period.

Figure 2A:
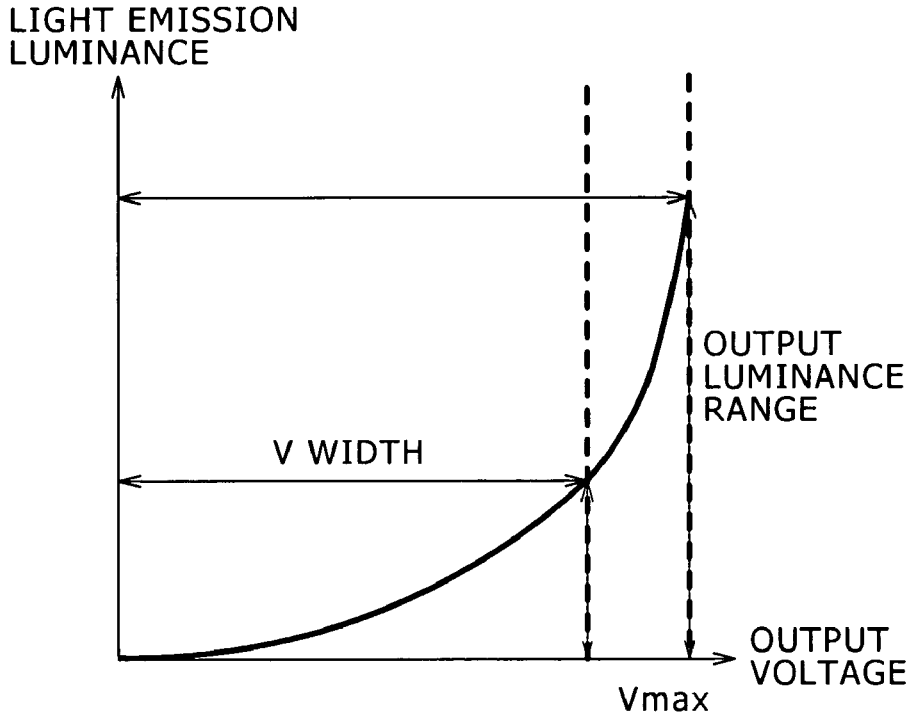
FIGS. 2A and 2B are diagrams illustrating relationships between the output voltage and the light emission luminance.
Figure 2B:
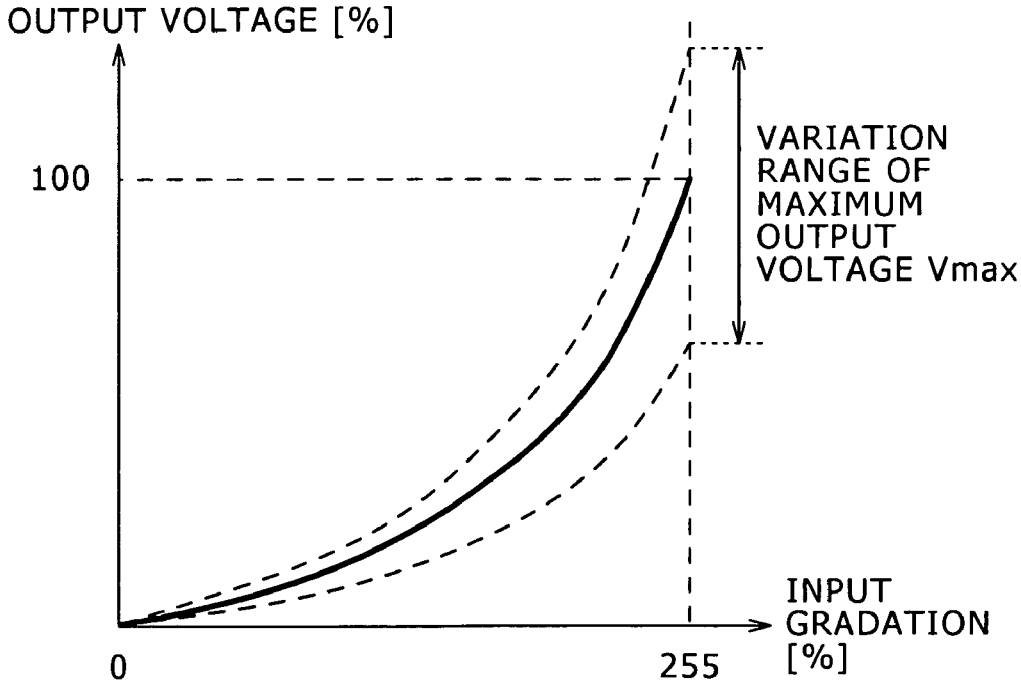

FIG. 2A illustrates a relationship between the output voltage applied to a display element and the light emission luminance of the display element. FIG. 2B illustrates an input/output relationship between the gradation value ($V_{max}$) of an input video signal and the output voltage applied to the display element. The reference voltage for the output voltage is represented by 100%.

In FIG. 2B, a curve indicated by a solid line indicates an input/output relationship corresponding to the reference value. Meanwhile, each curve indicated by a broken line indicates an input/output relationship where the maximum output voltage $V_{max}$ or maximum output current $I_{max}$ applied to the display element when maximum data is inputted is variably controlled. As seen from FIGS. 2A and 2B, the light emission luminance is variably controlled if the maximum output voltage $V_{max}$ or maximum output current $I_{max}$ is variably controlled even if the input gradation value is equal.

The peak luminance of the display panel is give by the product S of the output voltage $V_{max}$ (output current $I_{max}$) and the light emission time period.

Accordingly, if the light emission time period or the output voltage $V_{max}$ (output current $I_{max}$) is variably controlled individually, then the peak luminance of the display panel can be variably controlled.

B. Example of the Structure of the Organic EL Panel

Now, an example of a structure of an organic EL panel module which allows the dropping control of the peak luminance described above is described.

Figure 3:
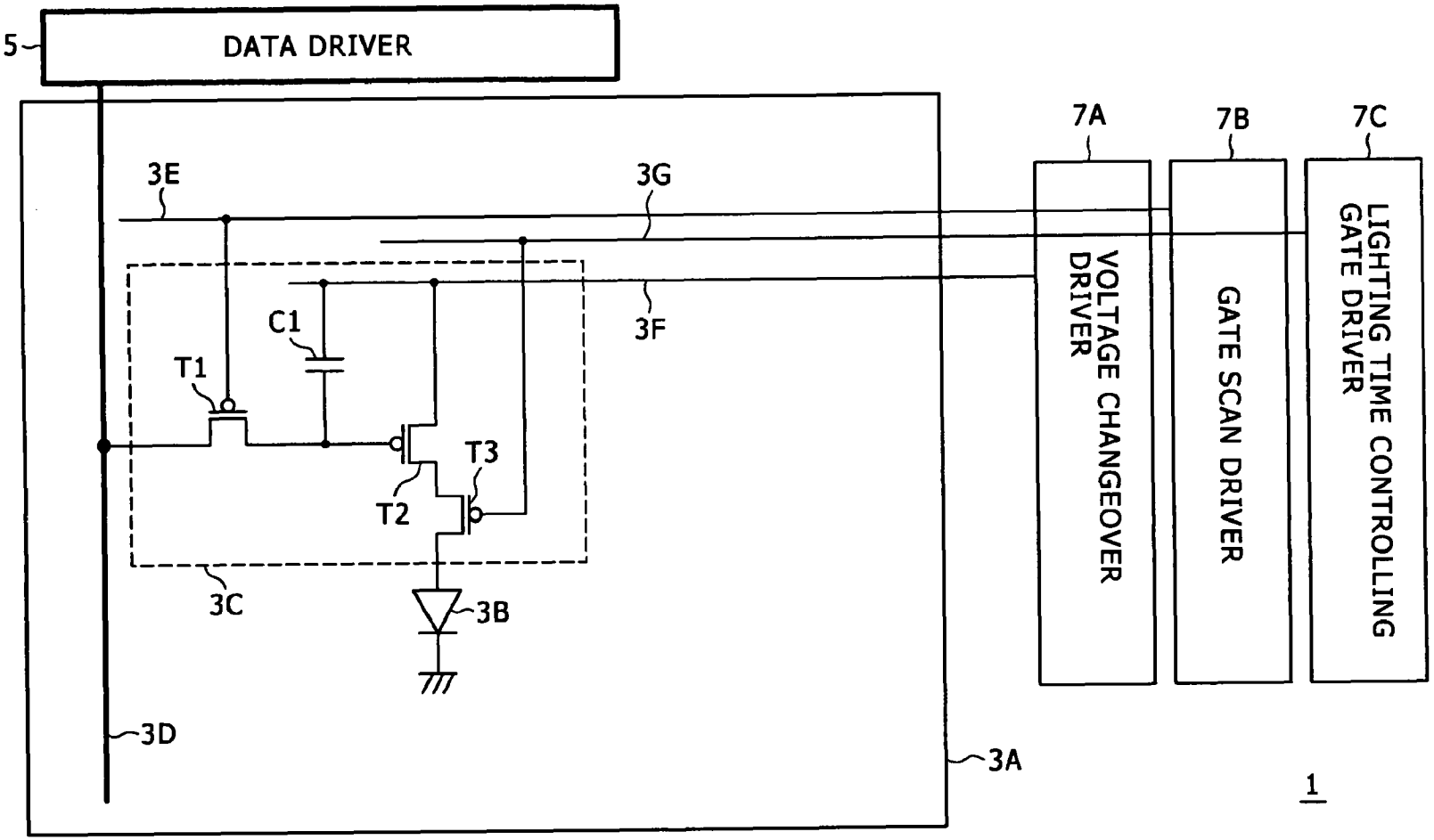
FIG. 3 is a block diagram showing an example of a structure of an organic EL panel module.

FIG. 3 shows an example of the structure of the organic EL panel module 1. Referring to FIG. 3, the organic EL panel module 1 includes a light emission region 3A in which organic EL elements 3B are arrayed in a matrix, and a panel driving circuit for controlling display of an image.

The panel driving circuit includes a data driver 5, a maximum output voltage controlling driver 7A, a gate scan driver 7B, and a lighting time controlling gate driver 7C. The panel driving circuit is formed at a peripheral portion of the light emission region 3A.

An organic EL element 3B corresponding to each pixel and a pixel driving circuit 3C for the organic EL element 3B are disposed at an intersecting point between each data line 3D and each scanning line 3E. The pixel driving circuit 3C includes a data switch element T1, a capacitor C1, a current driving element T2 and a lighting switch element T3.

The data switch element T1 is used to control the fetching timing of a voltage value provided through the data line 3D. The fetching timing is provided line-sequentially through the scanning line 3E.

The capacitor C1 is used to retain the fetched voltage value for a period of time of one frame. Plane-sequential driving is implemented by the use of the capacitor C1.

The current driving element T2 is used to supply current corresponding to the voltage value of the capacitor C1 to the organic EL element 3B. The driving current is supplied through a current supply line 3F. It is to be noted that a maximum output voltage $V_{max}$ is applied to the current supply line 3F through the maximum output voltage controlling driver 7A.

The lighting switch element T3 is used to control supply of the driving current to the organic EL element 3B. The lighting switch element T3 is disposed in series to the supply path of the driving current. The organic EL element 3B emits light while the lighting switch element T3 keeps a closed state. On the other hand, while the lighting switch element T3 is open, the organic EL element 3B emits no light.

Figure 4A:
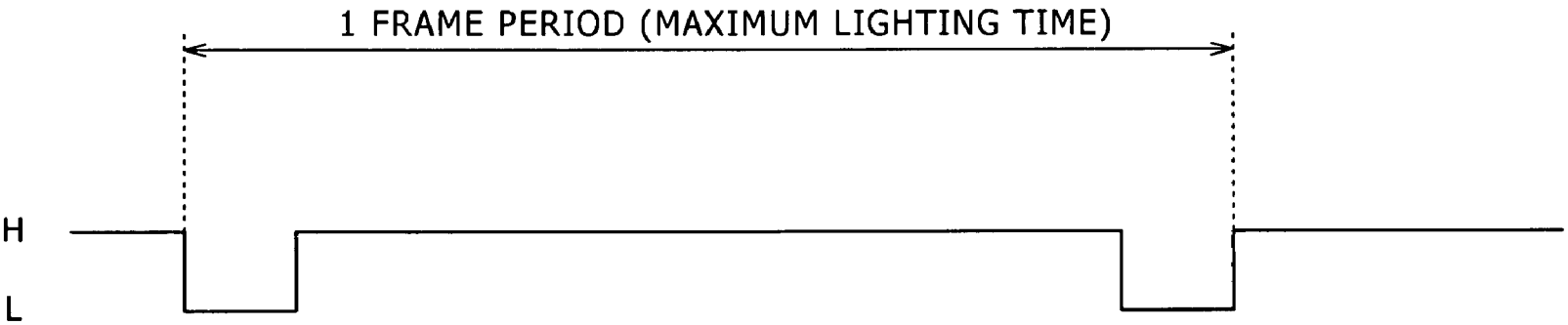
FIGS. 4A and 4B are waveform diagrams illustrating examples of a duty pulse for controlling the light emission time length.
Figure 4B:
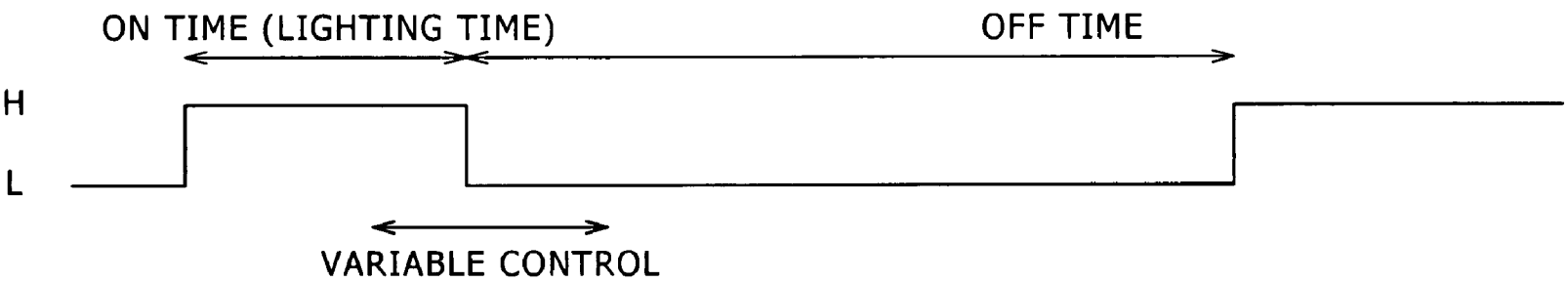

A lighting control line 3G supplies a duty pulse (FIG. 4B) for controlling the opening and closing action of the lighting switch element T3. It is to be noted that FIG. 4A illustrates a period of one frame as a reference period.

The application control of the voltage to be applied to the current supply line 3F is executed by the maximum output voltage controlling driver 7A. On the other hand, the variation control of the light emission time period is executed by the lighting time controlling gate driver 7C. Such control signals for the drivers are supplied from a light emission condition control apparatus hereinafter described.

It is to be noted that, where the peak luminance is controlled with the light emission time period length, the maximum output voltage controlling driver 7A supplies a fixed voltage for all frames. On the other hand, where the peak luminance is controlled with the maximum output voltage $V_{max}$, the lighting time controlling gate driver 7C supplies a duty pulse of a fixed ratio for all frames.

Figure 5:
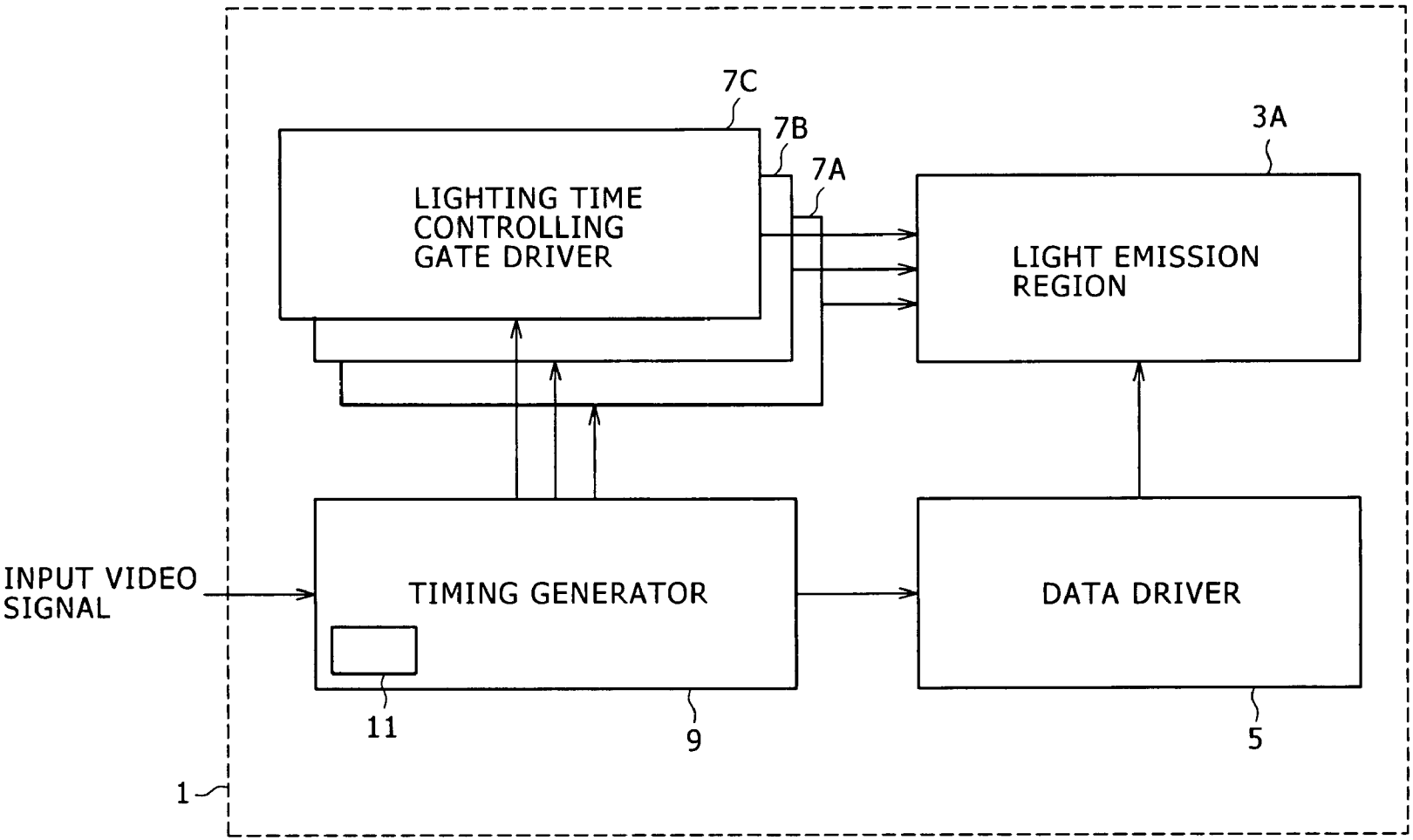
FIG. 5 is a block diagram showing an example of the structure of the organic EL panel module.

FIG. 5 shows an example of the structure of the organic EL panel module 1 which incorporates the light emission region 3A in which the pixel driving circuit 3C is formed. In the arrangement of FIG. 5, a peak luminance adjustment apparatus 11 is mounted as part of a timing generator 9.

It is to be noted that a peripheral circuit of the light emission region 3A, that is, the panel driving circuit, may be incorporated as a semiconductor integrated circuit on a panel board or may be formed directly on a panel board using a semiconductor process.

C. Examples of the Configuration of the Peak Luminance Adjustment Apparatus

Several examples of the configuration of the peak luminance adjustment apparatus 11 shown in FIG. 6 which can control the peak luminance of a video signal on the real time basis so that the total value of power consumption within a fixed period may not exceed a preset power amount are described below.

C-1. An Example of a Configuration of the Peak Luminance Adjustment Apparatus

Figure 6:
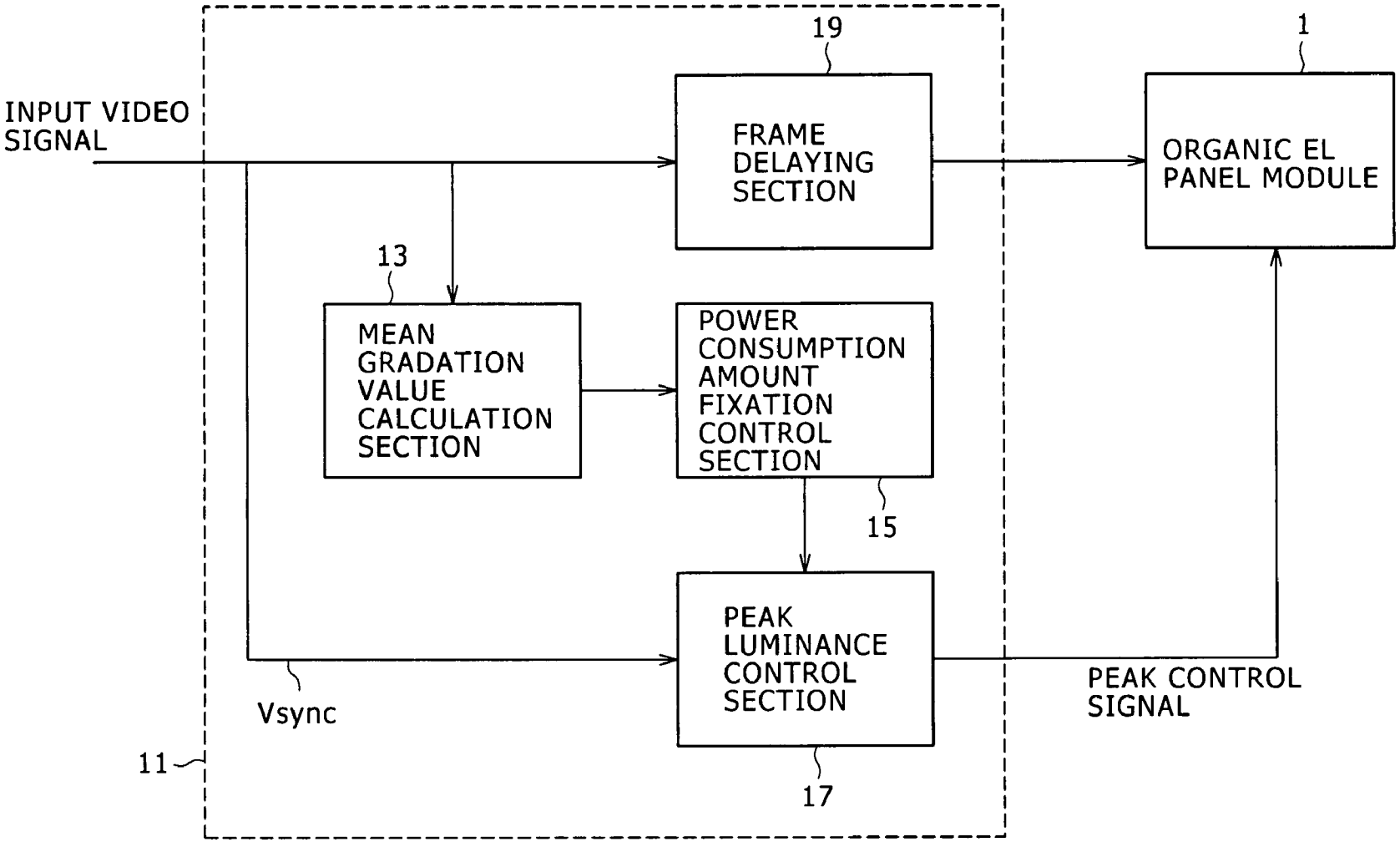
FIG. 6 is a block diagram showing an example of a configuration of a peak luminance adjustment apparatus shown in FIG. 5.

FIG. 6 shows one of examples of a configuration suitably adopted by the peak luminance adjustment apparatus 11.

Referring to FIG. 6, the peak luminance adjustment apparatus 11 according to the present configuration example includes a peak luminance adjustment apparatus 11, a mean gradation value calculation section 13, a power consumption amount fixation control section 15, a peak luminance control section 17, and a frame delaying section 19.

The mean gradation value calculation section 13 is a processing device for calculating a mean gradation value $APL_n$ of a video signal inputted within a period of one frame in a unit of a frame. The suffix n here signifies time such as, for example, a frame number.

Figure 7:
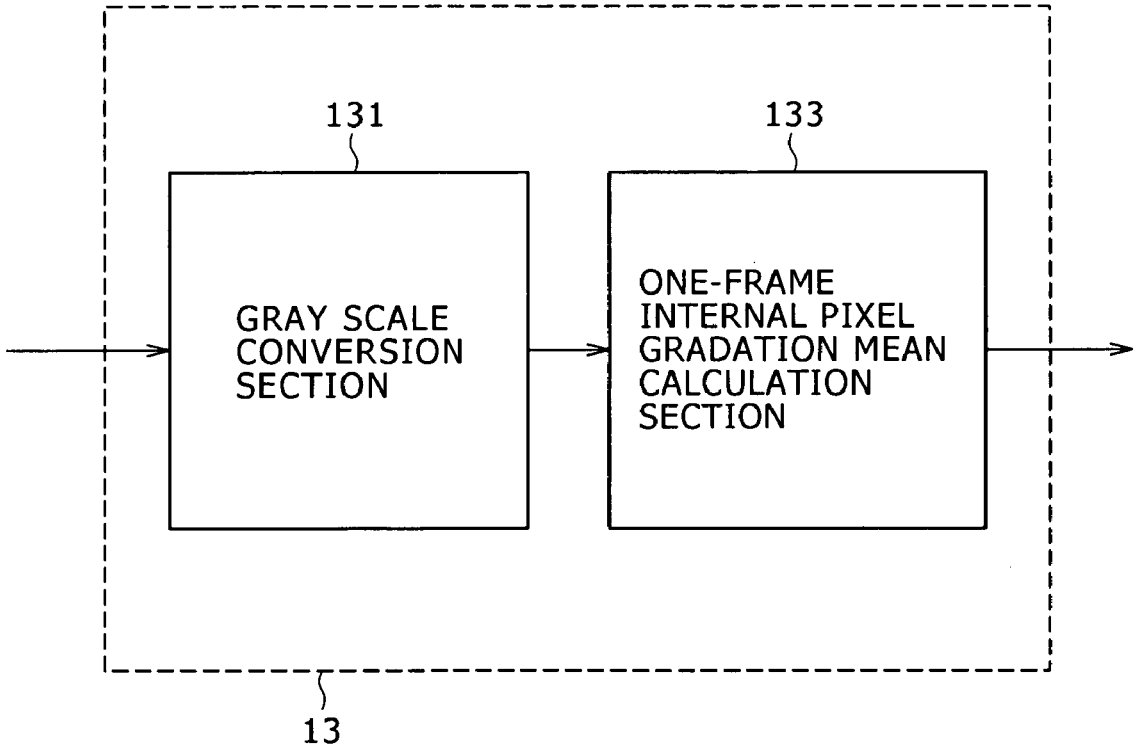
FIG. 7 is a block diagram showing an example of an internal configuration of a mean gradation value calculation section shown in FIG. 6.

FIG. 7 shows an example of an internal configuration of the mean gradation value calculation section 13. Referring to FIG. 7, the mean gradation value calculation section 13 shown includes a gray scale conversion section 131 and a one-frame internal pixel gradation mean calculation section 133.

The gray scale conversion section 131 is a processing device for converting the inputted video signal into a gray scale signal.

The one-frame internal pixel gradation mean calculation section 133 is a processing device for calculating a mean value of gradation values of all pixels which for one frame.

Referring back to FIG. 6, the power consumption amount fixation control section 15 is a processing device for adjusting the power consumption amount of each frame in response to a remaining power consumption amount so that the power consumption within a fixed period of time may remain within a preset power amount.

Figure 8:
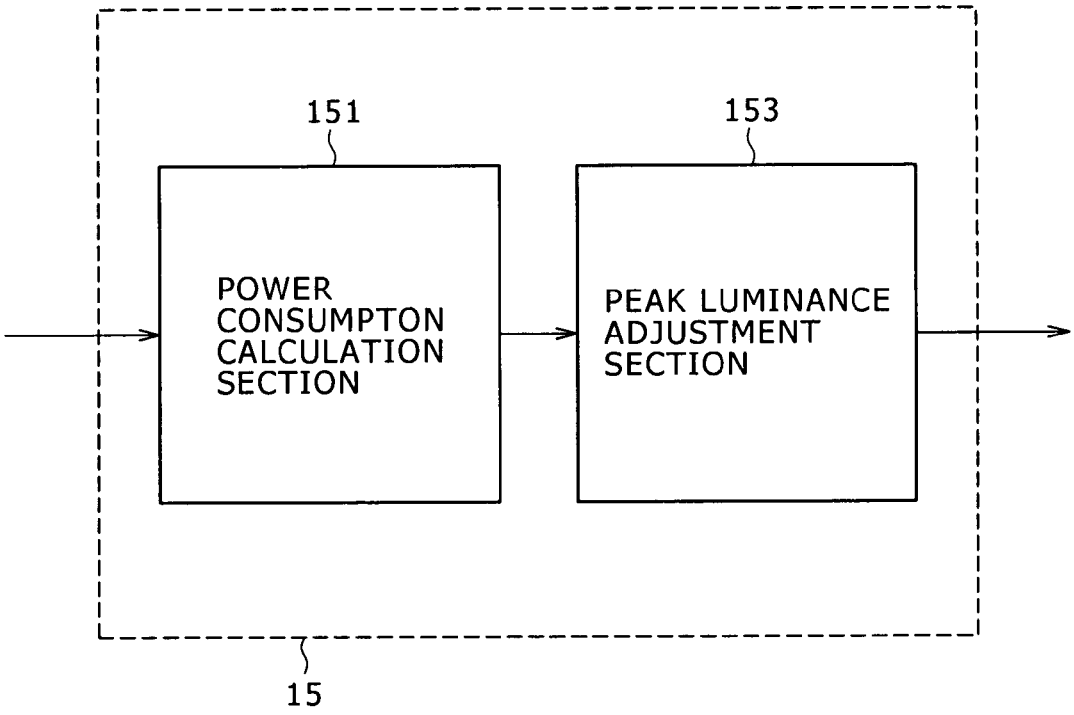
FIG. 8 is a block diagram showing an example of an internal configuration of a power consumption fixation control section shown in FIG. 6.

FIG. 8 shows an example of an internal configuration of the power consumption amount fixation control section 15. Referring to FIG. 8, the power consumption amount fixation control section 15 shown includes a power consumption calculation section 151 and a peak luminance adjustment section 153.

The power consumption calculation section 151 is a processing device for reading out a standard peak luminance corresponding to the calculated mean gradation value APL and calculating the power consumption amount to be consumed with the standard peak luminance and the calculated mean gradation value.

In the present configuration example, the standard peak luminance is given by a peak luminance magnification SEL_PK. The peak luminance magnification SEL_PK is a magnification to the reference peak luminance and is set in advance.

In this instance, the power consumption at a certain frame is given by the mean gradation value APL×peak luminance magnification SEL_PK×reference peak luminance.

The power consumption calculation section 151 reads out the peak luminance magnification SEL_PK corresponding to the mean gradation value APL using a lookup table illustrated in FIG. 9.

In the lookup table shown in FIG. 9, the peak luminance magnification SEL_PK is set such that, as the mean gradation value APL decreases, the peak luminance magnification SEL_PK increases. In FIG. 9, the peak luminance magnification SEL_PK is set to twice. This is because it is intended to assure a sufficiently high contrast even where a high luminance region is included in a screen whose mean gradation value is low, such as, for example, where a star twinkles on an image of the night sky.

On the other hand, in the lookup table shown in FIG. 9, as the mean gradation value APL increases, the peak luminance magnification SEL_PK decreases.

By defining the peak luminance magnification SEL_PK corresponding to the mean gradation value APL in such a manner as just described, a standard peak luminance determined with the picture quality taken into consideration is obtained.

Referring back to FIG. 8, the peak luminance adjustment section 153 is a processing device for adjusting the standard peak luminance calculated as described above so that the total value of the power consumption to be consumed within a fixed period does not exceed a preset power amount $S_{max}$. This is because, if no adjustment is performed, then the total value of the power consumption may exceed the preset power amount $S_{max}$depending upon the displayed substance.

The peak luminance adjustment section 153 adjusts the peak luminance of the pertaining frame in response to the ratio between an actual power consumption amount (remaining power amount) A which can be consumed within a reference period (control unit) and a power consumption amount B within the remaining period where the organic EL panel module 1 is always lit with the same peak luminance over an overall period of the reference period (control unit).

In particular, the peak luminance magnification $PK_n$ of the frame n is given by A/B×peak luminance magnification SEL-$PK_n$.

Here, the actual power consumption amount A is given by $(S_{n-1}-APL_n \times SEL_PK_n)$×reference peak luminance. Further, the power consumption amount B which can be consumed where the organic EL panel module 1 is normally lit with the same peak luminance is given by $((T_{flat}-n)\times APL_{flat})$×reference peak luminance.

It is to be noted that $T_{flat}$ is the number of frames set to the reference period. Further, $APL_{flat}$ is an APL set value for restricting the power consumption amount and is a mean gradation value in a unit of a frame in a case wherein the organic EL panel module 1 is lit with the same peak luminance over an overall period of the reference period so that the prescribed power consumption may be satisfied.

Incidentally, an initial value $S_0$ $(=S_{max})$ which provides a remaining power amount which can be consumed within a reference period is given by $T_{flat}\times APL_{flat}\times PK_{flat}$. $PK_{flat}$ is a peak luminance magnification corresponding to $APL_{flat}$.

Meanwhile, the power consumption amount A $(=S_n)$ where the organic EL panel module 1 is lit at the nth frame with the peak luminance magnification $PK_n$ is given, using the remaining power amount $S_{n-1}$, at the n−1th frame, by $S_{n-1}-APL_n\times PK_n$. It is to be noted that, since the reference peak luminance is omitted upon calculation, the power amount here does not include the reference peak luminance to be multiplied.

By such control as described above, the peak luminance magnification $PK_n$ corresponding to the mean gradation value of the input video signal is adjusted in the following manner.

For example, where a bright frame having a mean gradation value higher than a mean gradation value with which set power consumption is to be achieved successively appears and consequently the actual power consumption amount A is smaller than the power consumption amount B when lighting control is performed in average over the overall period, the peak luminance magnification $PK_n$ after the adjustment is controlled to a value lower than the peak luminance magnification $SEL_PK_n$ corresponding to the original mean gradation value.

On the other hand, where a dark frame having a mean gradation value lower than the mean gradation value with which the set power consumption is to be achieved successively appears and consequently the actual power consumption amount A is greater than the power consumption amount B when lighting control is performed in average over the overall period, the peak luminance magnification $PK_n$ after the adjustment is controlled to a value higher than the peak luminance magnification $SEL_PK_n$ corresponding to the original mean gradation value.

Referring back to FIG. 6, the peak luminance control section 17 modulates the reference pulse width corresponding to a lighting time period within one frame by an amount corresponding to the peak luminance magnification $PK_n$ provided thereto from the power consumption amount fixation control section 15. Then, the peak luminance control section 17 outputs a resulting pulse width signal as a duty ratio signal. The duty ratio signal is hereinafter referred to as "peak control signal".

It is to be noted that the peak luminance control section 17 generates the peak control signal at a timing synchronized with a vertical synchronizing signal $V_{sync}$ of the input video signal.

The frame delaying section 19 is a buffer memory for delaying the image signal so that the phases of the peak control signal to be outputted from the power consumption amount fixation control section 15 and the image signal to be outputted to the organic EL panel may coincide with each other. The delay time is set arbitrarily.

Figures 10A, 10B, 10C, 10D, 10E:
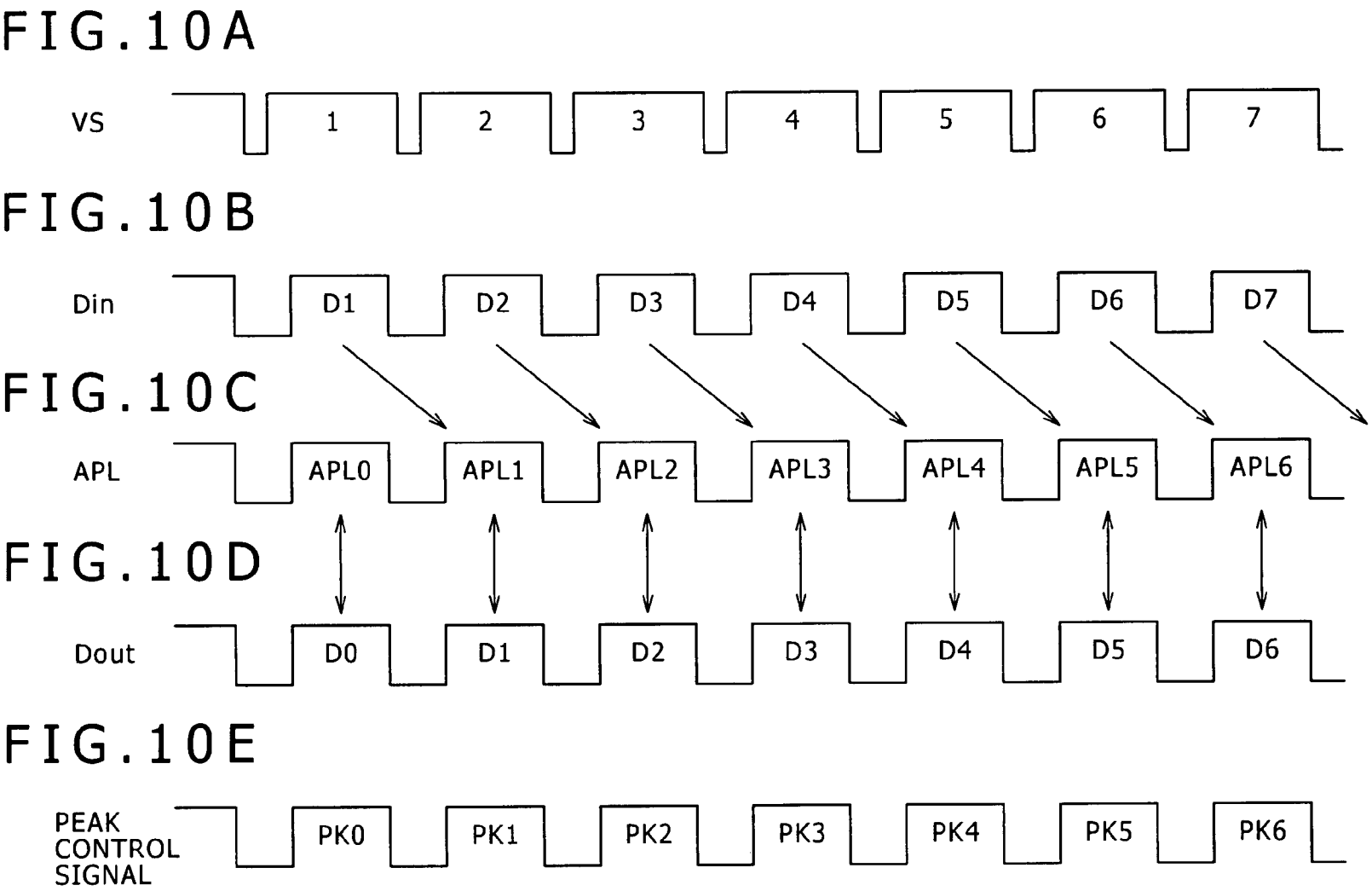
FIGS. 10A to 10E are waveform diagrams illustrating a relationship in phase of input and output frames.

FIGS. 10A to 10E illustrate a relationship in phase of input and output frames. In particular, FIG. 10A illustrates a frame number (phase) of the video signal VS, and FIG. 10B illustrates a number (phase) of image data inputted to the frame delaying section 19.

FIG. 10C illustrates a number (phase) of the mean gradation value APL outputted from the mean gradation value calculation section 13. FIG. 10D illustrates a number (phase) of image data outputted from the frame delaying section 19. FIG. 10E illustrates a peak control signal (phase) outputted from the peak luminance control section 17.

As can be seen from contrast between FIGS. 10B and 10D, image data is delayed by one frame by the frame delaying section 19. As a result, as seen in FIGS. 10D and 10E, synchronism between the video signal and the peak control signal is assured.

b. Flow of Processing Action of the Peak Luminance Adjustment Apparatus

Figure 11:
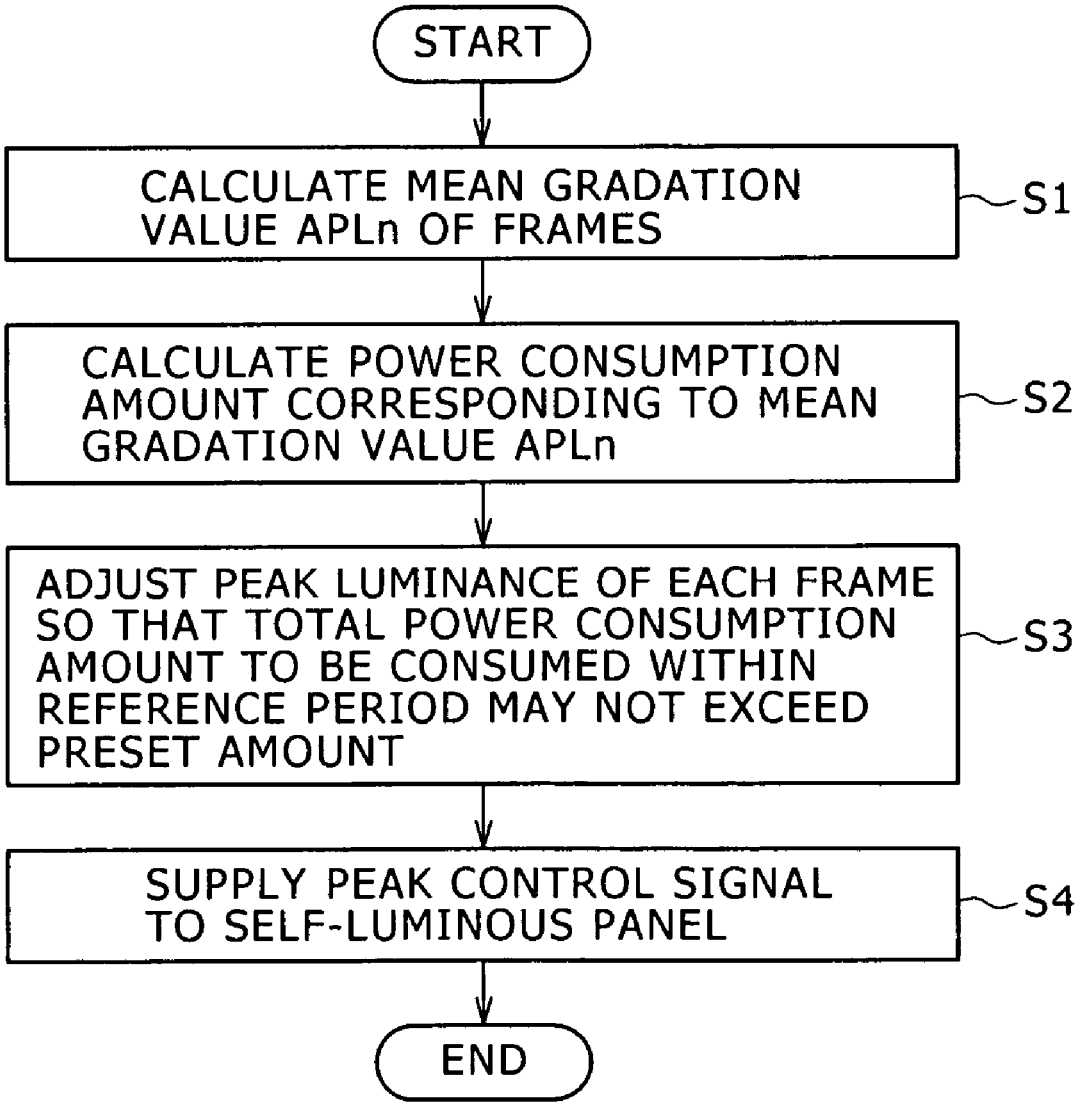
FIG. 11 is a flow chart illustrating an example of processing action executed by the peak luminance adjustment apparatus of FIG. 6.

FIG. 11 illustrates an outline of processing action executed by the peak luminance adjustment apparatus 11 having the configuration described above.

Referring to FIG. 11, the peak luminance adjustment apparatus 11 calculates the mean gradation value $APL_n$ of each frame at step S1 and determines the peak luminance magnification SEL_PK corresponding to the mean gradation value.

Thereafter, the peak luminance adjustment apparatus 11 uses the mean gradation value $APL_n$ of the current frame and the peak luminance magnification SEL_PK to calculate an original power consumption amount of the input video signal at step S2.

Then, the peak luminance adjustment apparatus 11 adjusts the peak luminance (magnification) of each frame so that the power consumption amount to be actually consumed within the reference period may not exceed a preset amount at step S3.

The peak luminance adjustment apparatus 11 outputs the peak control signal, which is pulse width modulated in response to the peak luminance (magnification) after the adjustment, to the organic EL panel module 1 at step S4.

Figure 12:
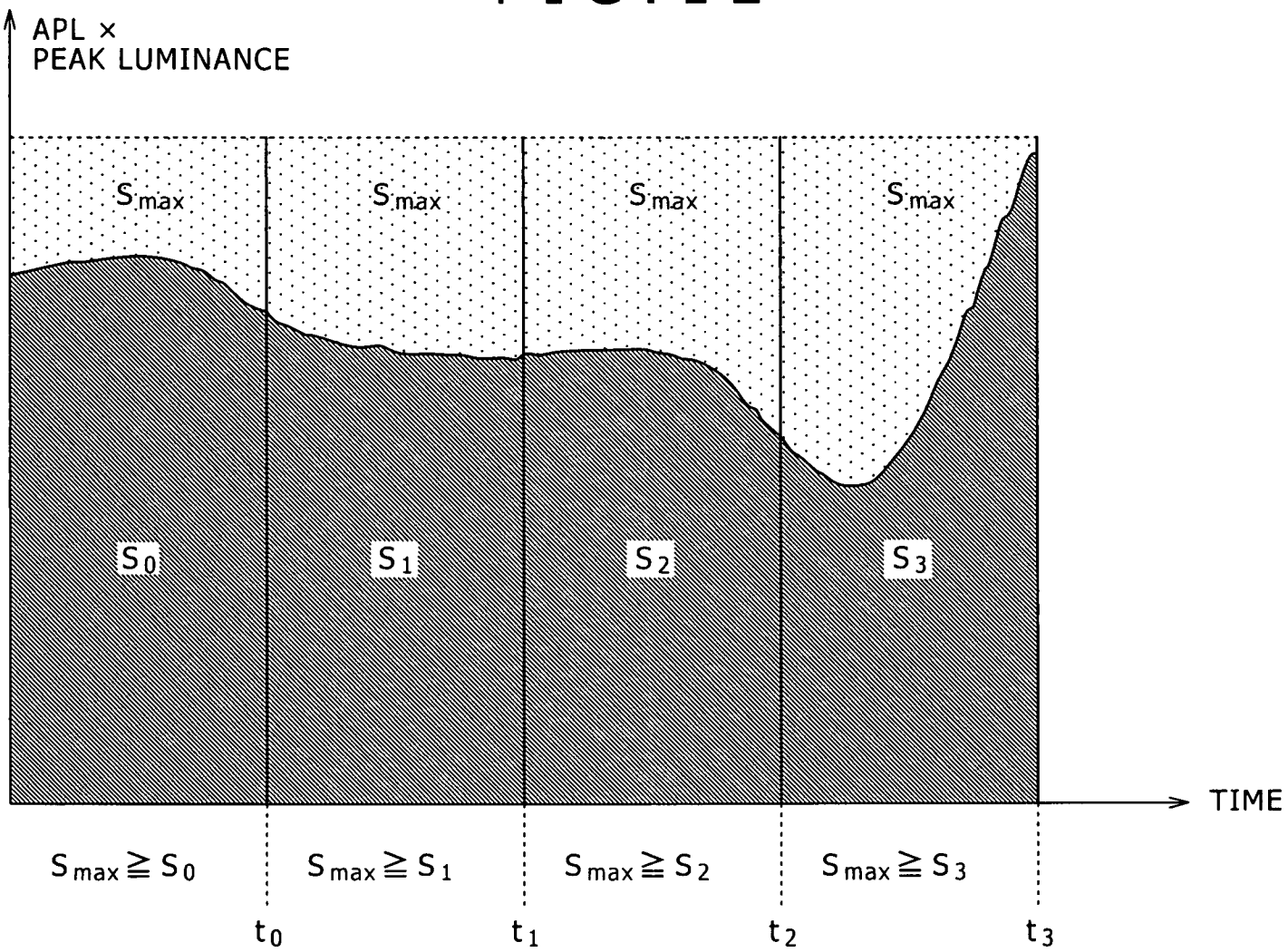
FIG. 12 is a diagram illustrating an example of transition of the power consumption amount by peak luminance adjustment.

FIG. 12 illustrates a transition of the power consumption amount where the peak luminance control function described above is applied. It can be seen from FIG. 12 that, within all reference periods ($0$-$t_0$, $t_0$-$t_1$, $t_1$-$t_2$, $t_2$-$t_3$, . . . ), the power consumption amount is suppressed lower than the preset power amount $S_{max}$ which can be consumed within the individual reference periods.

It is to be noted that $S_n$ (n=0, 1, 2, . . . ) is an actual power consumption amount within each reference period.

c. Achieved Effects

Where the peak luminance adjustment apparatus described above is mounted on a panel board, reduction of the power consumption or suppression of the power consumption of the organic EL panel can be achieved. Naturally, where the power consumption amount set in advance is satisfied even if lighting control is performed with a peak luminance corresponding to the input video signal, the input video signal can be displayed with high picture quality maintained.

Further, the variable adjustment function for a peak luminance described above provides a low arithmetic operation load even where it is implemented by software processing. Further, also where the variable adjustment function is implemented with an integrated circuit, it can be implemented as a very small scale circuit. Therefore, the variable adjustment function is advantageous in incorporation into an organic EL panel module.

D. Other Form Examples a. In the configuration examples described above, the peak luminance is variably controlled by adjustment of the light emission time period. However, the peak luminance may be variably controlled by adjustment of the maximum output voltage. Or, the peak luminance may be variably controlled by simultaneous adjustment of both of the light emission time period and the maximum output voltage.

b. In the configuration examples described above, a peak luminance magnification SEL_PK corresponding to a calculated mean gradation value APL is read out from the lookup table. However, the peak luminance magnification SEL_PK may otherwise be calculated in accordance with a relationship set in advance.

c. In the configuration examples, the organic EL panel module 1 incorporates both of the maximum output voltage controlling driver 7A and the lighting time controlling gate driver 7C.

However, the variable control function of the peak luminance can be implemented by variably controlling either one of the light emission time period and the maximum output voltage. Accordingly, where the method wherein the light emission time period is variably controlled is adopted, the configuration which does not incorporate the maximum output voltage controlling driver 7A may be adopted. However, where the method wherein the maximum output voltage is variably controlled is adopted, the configuration which does not include the lighting time controlling gate driver 7C may be adopted.

d. In the configuration examples described above, the present invention is applied to an organic EL display panel. However, the present invention can be applied also to an inorganic EL display panel. Further, the present invention can be applied also to, for example, an FED (field emission display) panel, an LED panel, a PDP (Plasma Display Panel) panel or the like.

e: In the configuration examples described above, the peak luminance adjustment apparatus 11 is mounted on the organic EL display panel.

However, such an organic EL display panel as described above or any other display apparatus may be in the form of a sole commodity or may be incorporated as part of some other image processing apparatus.

For example, the device mentioned can be implemented as a display device for a video camera, a digital camera or other image pickup apparatus (including not only a camera unit but also an image pickup apparatus formed integrally with a recording apparatus), an information processing terminal (portable computer, portable telephone set, portable game machine, electronic notebook and so forth) and a game machine.

Particularly, where the peak luminance adjustment apparatus 11 is incorporated in a battery-driven electronic apparatus, use for a longer period of time can be achieved with the battery capacity of an existing battery.

f. In the configuration examples described above, the peak luminance adjustment apparatus 11 is mounted on the organic EL display panel.

However, the peak luminance adjustment apparatus 11 may be incorporated in an image processing apparatus side which supplies an input video signal to an organic EL display panel or other display apparatus. In this instance, a system for supplying a duty pulse or a voltage value from the image processing apparatus to the display apparatus may be adopted, or alternatively another system wherein information indicating a duty pulse or a voltage value is supplied from the information processing apparatus to the display apparatus may be adopted.

g. In the form examples described above, the peak luminance adjustment apparatus 11 is described from the point of view of a functional configuration. However, it is a matter of course that equivalent functions can be implemented not only as hardware but also as software.

Further, all of the processing functions may be implemented as hardware or software, or part of the processing functions may be implemented using hardware or software. In other words, a combination configuration of hardware and software may be adopted.

h. The configuration examples described hereinabove may be modified in various manners within the spirit and scope of the present invention. Further, also various modifications and applications may be created or combined based on the disclosure of the present invention.

While a preferred embodiment of the present invention has been described using specific terms, such description is for illustrative purpose only, and it is to be understood that changes and variations may be made without departing from the spirit or scope of the following claims.

What is claimed is:

1. A self-luminous display apparatus capable of variably controlling a peak luminance of a self-luminous panel in a unit of one frame, comprising:

a mean gradation value calculation section that calculates within a period of one frame unit mean gradation values of a video signal respectively in units of one frame;

a power consumption calculation section that determines standard peak luminances corresponding to the calculated mean gradation values and that calculates power consumption amounts consumed respectively based on the standard peak luminances and the calculated mean gradation values; and a peak luminance adjustment section that adjusts the standard peak luminance based on the power consumption amounts calculated for at least two frames so that a total power consumption within a fixed period does not exceed a preset power amount, wherein the power consumption calculation section calculates the power consumption amounts by multiplying the mean gradation value, a peak luminance magnification, and a reference peak luminance.

2. The self-luminous display apparatus according to claim 1, wherein said peak luminance adjustment section calculates A/B×the peak luminance magnification as the standard peak luminance of a pertaining frame, where A is an actual power consumption amount consumed within a reference period of the fixed period, where B is a power consumption amount consumed within a remaining period of the fixed period, and where said self-luminous display apparatus is lit with a same peak luminance over an overall period of the reference period.

3. The self-luminous display apparatus according to claim 1, wherein the power consumption calculation section that determines peak luminance magnifications corresponding to the calculated mean gradation values by reading out from a correspondence table wherein combinations of several values of the mean gradation value and the peak luminance magnification are recorded.

4. The self-luminous display apparatus according to claim 1, wherein the standard peak luminances are peak luminance magnifications that are predetermined based on magnifications applied to reference peak luminances.

5. A peak luminance adjustment apparatus for adjusting a peak luminance of a self-luminous panel in a unit of one frame, comprising:

a mean gradation value calculation section that calculates within a period of one frame unit mean gradation values of a video signal respectively in units of one frame;

a power consumption calculation section that determines standard peak luminances corresponding to the calculated mean gradation values and that calculates power consumption amounts consumed respectively based on the standard peak luminances and the calculated mean gradation values; and a peak luminance adjustment section that adjusts the standard peak luminance based on the power consumption amounts calculated for at least two frames so that a total power consumption consumed within a fixed period does not exceed a preset power amount, wherein the power consumption calculation section calculates the power consumption amounts by multiplying the mean gradation value, a peak luminance magnification, and a reference peak luminance.

6. An electronic apparatus which incorporates a peak luminance adjustment apparatus for adjusting a peak luminance of a self-luminous panel in a unit of one frame, comprising:

a mean gradation value calculation section that calculates mean gradation values of a video signal respectively in units of one frame;

a power consumption calculation section that determines standard peak luminances corresponding to the calculated mean gradation values and that calculates power consumption amounts consumed respectively based on the standard peak luminances and the calculated mean gradation values; and a peak luminance adjustment section that adjusts the standard peak luminance based on the power consumption amounts calculated for at least two frames so that a total power consumption consumed within a fixed period does not exceed a preset power amount, wherein the power consumption calculation section calculates the power consumption amounts by multiplying the mean gradation value, a peak luminance magnification, and a reference peak luminance.

7. A peak luminance adjustment method for adjusting a peak luminance of a self-luminous panel in a unit of one frame, comprising:

calculating within a period of one frame unit mean gradation values of a video signal respectively in units of one frame;

determining standard peak luminances corresponding to the calculated mean gradation values and calculating power consumption amounts consumed respectively based on the standard peak luminances and the calculated mean gradation values; and adjusting the standard peak luminance based on the power consumption amounts calculated for at least two frames so that a total power consumption consumed within a fixed period does not exceed a preset power amount, wherein calculating the power consumption amounts is a multiplication of the mean gradation value, a peak luminance magnification, and a reference peak luminance.

8. A non-transitory computer readable medium for adjusting a peak luminance of a self-luminous panel in a unit of one frame, the computer readable medium storing program code which when executed by a computer performs operations comprising:

calculating within a period of one frame unit mean gradation values of a video signal respectively in units of one frame;

determining standard peak luminances corresponding to the calculated mean gradation values and calculating power consumption amounts consumed respectively based on the standard peak luminances and the calculated mean gradation values; and adjusting the standard peak luminance based on the power consumption amounts calculated for at least two frames so that a total power consumption consumed within a fixed period does not exceed a preset power amount, wherein calculating the power consumption amounts is a multiplication of the mean gradation value, a peak luminance magnification, and a reference peak luminance.

* * * * *